US005851381A

United States Patent [19]

Tanaka et al.

[11] Patent Number: 5,851,381

[45] Date of Patent: Dec. 22, 1998

[54] METHOD OF REFINING CRUDE OIL

[75] Inventors: Meishi Tanaka, Sodegaura; Shuji Sugiyama, Tokyo, both of Japan

[73] Assignee: Idemitsu Kosan Co., Ltd., Tokyo, Japan

[21] Appl. No.: 400,494

[22] Filed: Mar. 8, 1995

Related U.S. Application Data

[63] Continuation of Ser. No. 910,111, filed as PCT/JP91/01377, Oct. 9, 1991, abandoned.

[30] Foreign Application Priority Data

| | | | |
|---|---|---|---|
| Dec. 7, 1990 | [JP] | Japan | 2-406192 |
| Dec. 26, 1990 | [JP] | Japan | 2-414063 |
| Dec. 26, 1990 | [JP] | Japan | 2-414064 |

[51] Int. Cl.[6] ..... C10G 45/00; C10G 65/04; C10G 65/12

[52] U.S. Cl. ..... 208/210; 208/211; 208/212; 208/213; 208/217; 208/61; 208/89

[58] Field of Search ..... 208/49, 61, 67, 208/69, 80, 89, 210, 211, 212, 213, 218, 97, 217

[56] References Cited

U.S. PATENT DOCUMENTS

| | | | |
|---|---|---|---|
| 2,924,568 | 2/1960 | Anderson et al. | 208/213 |
| 2,945,803 | 7/1960 | Beuther et al. | 208/211 |
| 3,098,029 | 7/1963 | Snyder, Jr. | 208/61 |
| 3,119,765 | 1/1964 | Corneil et al. | 208/210 |
| 3,509,044 | 4/1970 | Adams et al. | 208/217 |
| 3,671,419 | 6/1972 | Ireland et al. | 208/57 |
| 3,730,879 | 5/1973 | Christman et al. | 208/210 |
| 3,755,141 | 8/1973 | Youngblood et al. | 208/67 |
| 3,775,290 | 11/1973 | Peterson et al. | 208/50 |
| 3,801,495 | 4/1974 | Gould | 208/97 |
| 4,212,729 | 7/1980 | Hensley, Jr. et al. | 208/210 |

FOREIGN PATENT DOCUMENTS

| | | |
|---|---|---|
| 40-1258 | 1/1940 | Japan . |
| 42-26104 | 12/1942 | Japan . |
| 55-18499 | 2/1980 | Japan . |
| 50-37043 | 11/1980 | Japan . |
| 55-44796 | 11/1980 | Japan . |
| 2 026 533 | 2/1980 | United Kingdom . |

OTHER PUBLICATIONS

Hobson, G.D., "Modern Petroleum Technology", pp. 367–369, Jun. 1973.

Auidan, A.A., "Recent and Future Developments in FCC", 1991, pp. 43–64.

*Primary Examiner*—Walter D. Griffin

*Attorney, Agent, or Firm*—Frishauf, Holtz, Goodman, Langer & Chick, P.C.

[57] ABSTRACT

A method of refining crude oil by distillation and desulfurization for the preparation of petroleum products can reduce cost of apparatus and cost of operation and can be operated with better stability by simplified control of operation. In the method, a naphtha fraction is separated from crude oil by distillation, the residual fraction which remained after the naphtha fraction has been removed from the crude oil is hydrodesulfurized and the hydrodesulfurized fraction is separated into further fractions by distillation. A kerosene fraction and a gas oil fraction of high quality can be obtained and yields of intermediate fractions such as kerosene and gas oil can be increased by introducing a hydrotreating process, a high pressure separation process and a residue fluid catalytic cracking process in a sophisticated way for refining of the residual fraction remained after the naphtha fraction has been removed from the crude oil.

19 Claims, 4 Drawing Sheets

METHOD OF REFINING CRUDE OIL

This application is a Continuation, of application Ser. No. 07/910,111, filed Jul. 1, 1992, now abandoned which is the United States national phase application of International application No. PCT/JP91/01377 filed Oct. 9, 1991.

TECHNICAL FIELD

The present invention relates to a novel method of refining crude oil. More particularly, the present invention relates to a novel method of refining crude oil with higher efficiency by simplified unit.

BACKGROUND ART

According to the generally utilized methods, crude oil is made into products of various fractions by distillation of the crude oil at the atmospheric pressure. Each product is then treated to a quality level of refining suited for the purpose of the individual products by appropriate methods such as hydrogenation and the like.

In these methods, the number of the units utilized for the refining is necessarily increased and, at the same time, the units are complicated because the treatments for the refining are made separately for each of the fractions after the crude oil is separated into the fractions.

Yields of individual products and the content of sulfur are varied depending on the kind of crude oil utilized. The same unit is utilized for desulfurization of both of kerosene and gas oil. Because of these reasons, it has been the general practice that intermediate tanks are installed between the units for various processes and fractions are temporarily stored in these intermediate tanks. This practice requires additional expenditures as well as additional space to install them. The fractions are cooled down during the storage in the intermediate tanks and energy is not utilized efficiently in these systems of units.

Furthermore, the number of units is increased and the operation of each unit for refining must be controlled separately. The number of equipments required for the control of operation and other related equipments are increased. This situation inevitably leads to complicated control of operation.

It has naturally been desired that the cost for unit is decreased by simplifying the units, the cost for operation is decreased by efficient utilization of energy and the control of operation for the total system is made more easily.

As the method of increasing efficiency of refining crude oil, the following four methods, ①~④, have been known.

① A method comprising pressuring of crude oil, separation of the crude oil into a light fraction and a heavy fraction by mixing hydrogen into the pressured crude oil, further pressuring of the heavy fraction and, then, hydrodesulfurization of the heavy fraction by mixing hydrogen into the heavy fraction (Japanese Patent Publication Showa 5037043).

② A method comprising heat exchange of crude oil with a fraction made by hydrodesulfurization and/or hydrocracking of the heavy fraction and, then, distillation of the fraction under pressure (Japanese Patent Publication Showa 51-21407).

③ A method comprising pressuring of crude oil, separation of the crude oil into a light fraction and a heavy fraction by mixing hydrogen with the crude oil and, then, hydrodesulfurization of the light fraction (Japanese Patent Publication Heisei 2-25952).

④ A method of preparation of hydrocarbon oil having a high cetane number by hydrotreating of a fraction having boiling point of 150°~360° C. formed by fluid catalytic cracking of heavy oil (Japanese Laid-open Patent Publication Showa 63-29185).

However, a fraction having satisfactory stability is not obtained by any of the methods described above. In conventional methods, the desulfurization treatment is made on individual fractions separately after the crude oil is fractionated into kerosene, gas oil, heavy gas oil and residual oil. Technological applicability has not been established for treating the combined fractions at the same time.

DISCLOSURE OF THE INVENTION

Extensive investigations were undertaken by the present inventors with an object of developing a method of of refining crude oil which can reduce the cost of unit and the cost of operation and can realize the stable operation by a simplified method of the operation control, a method of obtaining fractions having the superior properties by a simplified process, a method of improving the qualities of intermediate fractions, such as kerosene and gas oil, a method of improving the life of the catalyst utilized and a method of increasing the yields of the intermediate fractions. It was discovered that the object described above can be attained by a method comprising separation of a naphtha fraction from crude oil, desulfurization of the residual fraction and, then, separation of the desulfurized fraction into further fractions by distillation or by a method comprising separation of a naphtha fraction from crude oil and distillation of the residual fraction after the treatment of the residual fraction for refining by well arranged introduction of hydrotreating, separation under high pressure and fluid catalytic cracking of the heavy residual oil. The present invention was completed on the basis of the discovery.

The present invention provides a method of refining crude oil by distillation and desulfurization for preparation of petroleum products which comprises separating a naphtha fraction from crude oil by distillation, hydrodesulfurizing the residual fraction which remains after the naphtha fraction has been removed from the crude oil and separating the hydrodesulfurized fraction into further fractions by distillation (Embodiment 1).

The present invention also provides a method of refining crude oil by distillation and desulfurization for preparation of petroleum products which comprises separating a naphtha fraction from crude oil by distillation, hydrodesulfurizing the residual fraction which remains after the naphtha fraction has been removed from the crude oil, hydrotreating the hydrodesulfurized fraction and separating the hydrotreated fraction into further fractions by distillation (Embodiment 2).

The present invention further provides a method of refining crude oil by distillation and desulfurization for preparation of petroleum products which comprises separating a naphtha fraction from crude oil by distillation, hydrodesulfurizing the residual fraction which remains after the naphtha fraction has been removed from the crude oil, separating the hydrodesulfurized fraction into a light fraction and a heavy residual oil in a high pressure separator and hydrotreating the light fraction (Embodiment 3).

The present invention still further provides a method of refining crude oil by distillation and desulfurization for preparation of petroleum products which comprises separating a naphtha fraction from crude oil by distillation, hydrodesulfurizing the residual fraction which remains after the naphtha fraction has been removed from the crude oil, separating the hydrodesulfurized fraction into a light fraction and a residual heavy oil in a high pressure separator, cracking the heavy residual oil by fluid catalytic cracking, fractionating the cracked heavy residual oil by distillation, combining a cracked gas oil obtained by the fractionation by distillation with the light fraction separated in the high pressure separator and hydrotreating the combined fraction (Embodiment 4).

Figure 1:
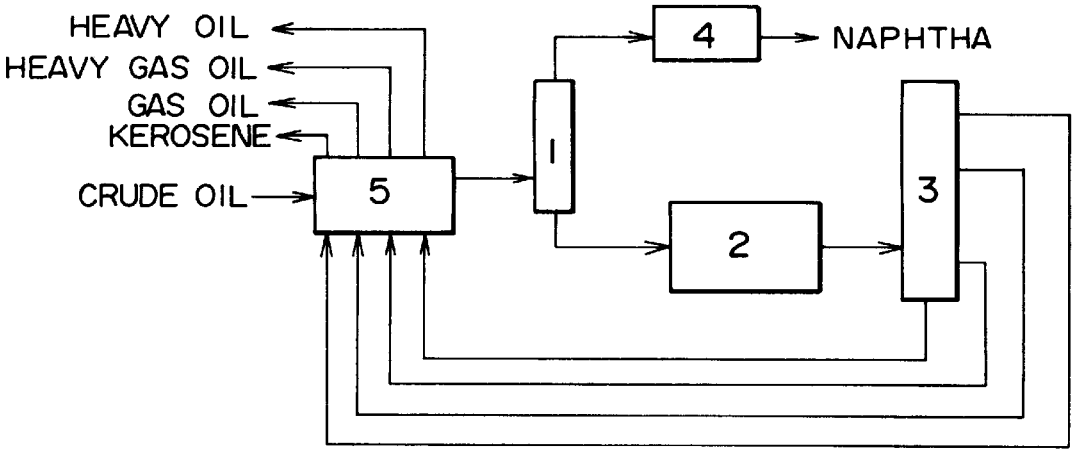
FIG. 1~FIG. 4 are schematic flow diagrams of examples of the basic constitutions of units to perform the present invention.

The numbers shown in the figures have the following meanings:

1: a preliminary distillation tower

2: a hydrodesulfurization unit

3: a atmospheric distillation tower

4: a hydrodesulfurization unit (for naphtha)

5: a heat exchanger

6: a hydrotreating unit

7: a high pressure separator

8: a fluid catalytic cracking unit of heavy residual oil.

THE MOST PREFERRED EMBODIMENT TO CARRY OUT THE INVENTION

Embodiment 1 described above will be explained first.

FIG. 1 is a schematic flow diagram of an example of a basic constitution of units to perform Embodiment 1 of the present invention.

The units for refining in Embodiment 1 comprise preliminary distillation tower 1 for separation of a naphtha fraction in the crude oil by distillation, a unit for desulfurization of the residual fraction which remains after the naphtha fraction has been removed, such as the hydrodesulfurization unit 2 for desulfurizing the residual fraction by the contact with a desulfurizing catalyst in the presence of hydrogen, an atmospheric distillation tower 3 for fractionation of the residual fraction treated by the desulfurization process into fractions, such as kerosene, gas oil, heavy gas oil and the residual crude, an hydrodesulfurization unit 4 for desulfurizing the naphtha fraction separated from the crude oil in the preliminary distillation tower 1 and a heat exchanger 5 for recovery of heat.

In the preliminary distillation tower 1, the naphtha fraction ($C_5$~157° C.) in the crude oil is, at first, separated from the crude oil by distillation. The optimum condition of the distillation is suitably adopted according to the composition and the properties of the crude oil and the constitution and the stage number of the distillation tower. The generally adopted condition is a pressure in the range from the atmospheric pressure to 10 kg/cm$^2$G and a temperature in the range from 145° to 200° C. It is preferable that the naphtha fraction in the crude oil is separated at a pressure around 1.5 kg/cm$^2$G and at a temperature in the range described above. The naphtha fraction separated in the preliminary distillation tower 1 is desulfurized in the hydrodesulfurization unit 4 by utilizing a conventional method. For example, the content of sulfur in the naphtha fraction can be made 1 weight ppm or less by the desulfurization by utilizing a Co—Mo catalyst, at the temperature in the range from 280° to 340° C., at the pressure in the range from 18 to 40 kg/cm$^2$G, at the liquid hourly space velocity (LHSV) in the range from 3 to 10 hr$^{-1}$ and at the amount of hydrogen in the range from 50 to 100 Nm$^3$/kl. The separation of the naphtha fraction is preferably made by distillation but other methods such as flashing operation may be utilized.

The heavy fraction comprising the kerosene fraction and other heavier fractions which is the residual fraction in the preliminary distillation tower 1 is introduced into the hydrodesulfurization unit 2 without separating into its components. It is desirable that the hydrodesulfurization unit 2 is operated so that the content of sulfur in the final heavy residual oil is controlled within a specified range of amount. For example, when the content of sulfur in the heavy residual oil is controlled within 1 weight % or less, preferably within 0.5 weight % or less, the temperature in the range from 300° to 450° C., the pressure in the range from 50 to 400 kg/cm$^2$G, LHSV in the range from 0.1 to 5.0 hr$^{-1}$ and the amount of hydrogen in the range from 500 to 5,000 Nm$^3$/kl, in the presence of a generally utilized catalyst for hydrodesulfurization, such as a catalyst which comprises one or more than one kinds of metals of the VIth group or the VIIIth group of the Periodic Table, like Mo, W, Co and Ni, preferably Co—Mo and Ni—Mo, supported on a support, like alumina, silica, zeolite, a mixture thereof and the like, are preferred as the condition of the operation. The temperature in the range from 370° to 420° C., the pressure in the range from 100 to 200 kg/cm$^2$G, LHSV in the range from 0.2 to 2.0 hr$^{-1}$ and the amount of hydrogen in the range from 800 to 2,000 Nm$^3$/kl are more preferable. Sulfur contained in other fractions than the heavy residual oil can be sufficiently removed by this method.

As the next process, the the fraction desulfurized by the above process is introduced to the atmospheric distillation tower and separated into the individual fractions. For example, the fraction is separated into the kerosene fraction, the gas oil fraction, the heavy gas oil fraction and the residual crude by setting the cutting temperatures at atmospheric pressure at the range from $C_5$ to 157° C. for the naphtha fraction, at the range from 157° to 239° C. for the kerosene fraction, at the range from 239° to 371° C. for the gas oil fraction, at the range from 371° to 472° C. for the heavy gas oil fraction and at the range from 472° C. to higher temperatures for the residual crude.

The fractions ranging from the kerosene fraction to the residual oil fraction which come out from the main distillation tower 3 can, after the heat is recovered by utilizing the heat exchanger 5 with the crude oil, be sent for storage directly to the storage tanks of the corresponding products or delivered directly to customers because the fractions have already been finished with the treatment of desulfurization.

When the crude oil is introduced directly into the hydrodesulfurization process without removing the naphtha fraction in the crude oil by the preliminary distillation, it is quite difficult that sulfur in the naphtha fraction is removed to the amount below the required level and the content of sulfur cannot be reduced to the order of ppm. In this condition, the sulfur contained in the material acts as the poison to a reforming catalyst and may cause a problem in the processes following the desulfurization.

When, as described above, the desulfurization is made after the removal of the naphtha fraction and the fractions such as the kerosene fraction and the other fractions having higher boiling points are separated after the desulfurization, the units necessary for refining the crude oil are simplified to a great extent while the properties of the products are maintained at the same level or better than conventional products. Energy losses accompanied with the charging and discharging of materials to the intermediate tanks can be eliminated by removing the intermediate tanks. Because the process of desulfurization is performed on the combined fractions at the same time, the control of operation is made more easily and it is further possible that the cost of investment for control instruments is reduced and the number of operator is reduced.

According to Embodiment 1, unstable substances which may be formed during the desulfurization process can be separated and removed during distillation in the atmospheric distillation tower. Thus, the stability of the gas oil fraction as the intermediate fraction can be improved. By performing the desulfurization so as to reduce the content of sulfur in the heavy residual oil to the value below the specified level, the content of sulfur in the light fractions can be reduced to the value below the level of conventional products.

The method of Embodiment 2 which is described in more detail in the following provides fractions having still better properties by a simplified process.

Figure 2:
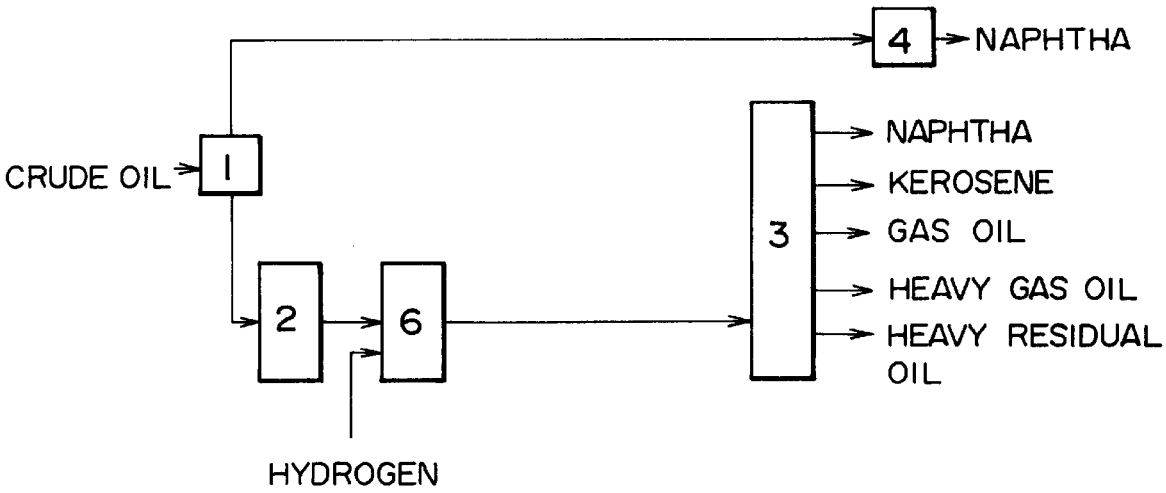

FIG. 2 is the schematic flow diagram of the basic constitution of the units to perform the method of Embodiment 2.

The units for refining to perform Embodiment 2 comprise the preliminary distillation tower 1 to separate the naphtha fraction in the crude oil by distillation, the desulfurization unit to desulfurize the residual fraction after the naphtha fraction has been removed, for example the hydrodesulfurization unit 2 to desulfurize the residual fraction by contact with a desulfurization catalyst in the presence of hydrogen, the hydrotreating unit 6 to remove nitrogen-containing compounds and other impurities from the fraction after the desulfurization and the atmospheric distillation tower 3 to fractionate the purified fraction by distillation into individual fractions, such as kerosene, gas oil, heavy gas oil and the residual crude. The refining units for performing Embodiment 2 also comprise the hydrodesulfurization unit 4 to desulfurize the naphtha fraction separated in the preliminary distillation tower 1.

The naphtha fraction ($C_5$~157° C.) in crude oil is, at first, separated from the crude oil by distillation from the crude oil in the preliminary distillation tower 1. The condition of distillation is similar to the condition described in performing Embodiment 1. The content of residual sulfur in the naphtha fraction can be made 1 weight ppm or less by the distillation process. The separation of the naphtha fraction is preferably made by distillation but other methods such as flashing operation may be utilized.

The heavy fraction comprising the kerosene fraction and other heavier fractions which is the residual fraction in the preliminary distillation tower 1 is introduced into the apparatus for hydrodesulfurization 2 without separating into its components. It is desirable that the apparatus for desulfurization 2 is operated so that the content of sulfur in the final heavy residual oil is controlled within a specified range of amount. The condition of operation is similar to the condition described in performing Embodiment 1.

The fraction desulfurized in the process described above is then introduced into the hydrotreating unit 6 without separating into the component fractions. It is desirable that the operation of the hydrotreating unit 6 is controlled so that the content of sulfur in the final residual oil is controlled within the specified range of amount and, at the same time, other impurities such as nitrogen-containing impurities are removed. The temperature in the range from 300° to 400° C., the pressure in the range from 50 to 400 kg/cm$^2$G, the LHSV in the range from 0.1 to 5.0 hr$^{-1}$ and the amount of hydrogen in the range from 500 to 5,000 Nm$^3$/kl in the presence of a catalyst comprising a metal of the VIth group of the Periodic Table (preferably Mo or W contained as oxides preferably in the amount of 10 weight % or more, more preferably in the amount of 15 weight % or more) and a metal of the VIIth group of the Periodic Table (preferably Ni contained as oxides preferably in the amount of 1 weight % or more, more preferably in the amount of 3~8 weight %), supported on a support, such as silica and/or alumina, zeolite, boron oxide and a mixture thereof, preferably on a porous support having pores of average pore diameter preferably of 60~200 Å, more preferably of 80~120 Å are preferred as the condition of operation. The temperature in the range from 320° to 360° C., the pressure in the range from 100 to 200 kg/cm$^2$G, the LHSV in the range from 0.2 to 2.0 hr$^{-1}$ and the amount of hydrogen in the range from 800 to 2,000 Nm$^3$/kl are more preferred as the conditions of operation, though the preferable conditions may be different depending on the situation.

The fraction hydrotreated by the above process is introduced into the atmospheric distillation tower 3 and fractionated into further fractions. The condition of the atmospheric distillation is similar to the condition described in performing Embodiment 1.

Because the fractions ranging from the kerosene fraction to the heavy residual oil fraction which come out of the atmospheric distillation tower 3 are already hydrodesulfurized and hydrotreated, they can, after the heat is recovered by utilizing the heat exchanger with the crude oil according to necessity, be sent for storage directly to the storage tanks of the corresponding products or delivered directly to customers. The naphtha fraction can be desulfurized by the hydrodesulfurization unit 4 together with the naphtha separated from the crude oil according to necessity.

When crude oil is directly introduced into the desulfurization process without removing the naphtha fraction from the crude oil in the preliminary distillation tower, it is quite difficult that sulfur in the naphtha fraction is removed to the amount below the required level and the content of sulfur cannot be reduced to 1 weight ppm or less. In this condition, the sulfur contained in the material acts as the poison to a reforming catalyst and may cause a problem in the processes following the desulfurization.

When, as described above, the desulfurization is made after the removal of the naphtha fraction and the fractions such as the kerosene fraction and the other fractions having higher boiling points are separated after the desulfurization, the units necessary for refining the crude oil are simplified to a great extent while the properties of the products are maintained at the same level or better than conventional products. Energy losses accompanied with the charging and discharging of materials to the intermediate tanks can be eliminated by removing the intermediate tanks. Because the process of desulfurization and the process of hydrotreating are performed on the combined fractions at the same time, the control of operation is made more easily and it is further possible that the cost of investment for control instruments is reduced and the number of operator is reduced.

According to Embodiment 2, unstable substances which may be formed during the desulfurization process can be separated and removed during distillation in the main distillation tower. By performing the desulfurization so as to reduce the content of sulfur in the heavy residual oil to the value below the specified level, the content of sulfur in the light fractions can be reduced to the value below the level of conventional products. Stability of the gas oil fraction can be improved by the process of Embodiment 2 because impurities such as nitrogen-containing compounds in light fractions can be removed by hydrotreating.

The method of Embodiment 3 which is described in more detail in the following provides intermediate fractions such as kerosene and gas oil having still better properties by a simplified process and longer life of catalysts utilized.

Figure 3:
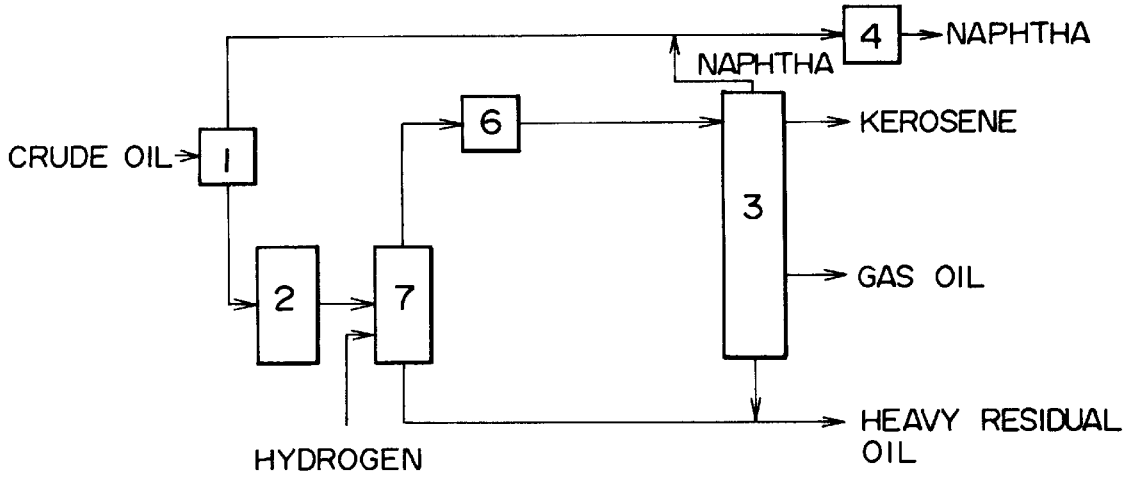

FIG. 3 is the schematic flow diagram of an example of the basic constitution of the units to perform the method of Embodiment 3.

The units for refining to perform Embodiment 3 comprise the preliminary distillation tower 1 to separate the naphtha fraction in the crude oil by distillation, the desulfurization unit to desulfurize the residual fraction after the naphtha fraction has been removed, for example the hydrodesulfurization unit 2 to desulfurize the residual fraction by contact with a desulfurization catalyst in the presence of hydrogen, the high pressure separator 7 to separate fractions at a high pressure after the desulfurization, the hydrotreating unit 6 to refine the light fractions separated in the high pressure separator and the atmospheric distillation tower 3 to fractionate the refined fraction by distillation into individual fractions, such as naphtha, kerosene and gas oil. The refining units for performing Embodiment 3 also comprise the hydrodesulfurization unit 4 to desulfurize the naphtha fraction separated in the preliminary distillation tower 1.

The naphtha fraction ($C_5$~157° C.) in crude oil is, at first, separated from the crude oil by distillation in the preliminary distillation tower 1. The condition of distillation is similar to the condition described in performing Embodiment 1.

The heavy fraction comprising the kerosene fraction and other heavier fractions which is the residual fraction in the preliminary distillation tower 1 is introduced into the hydrodesulfurization unit 2 without separating into its components. It is desirable that the hydrodesulfurization unit 2 is operated so that the content of sulfur in the residual oil is controlled within a specified range of amount. The operation conditions are similar to the conditions described previously.

The fraction desulfurized in the above process is introduced into the high pressure separator 7 without preliminary separation into its components and then separated into the lighter fraction and the heavy residual fraction. Various methods can be utilized for the separation in the high pressure separator. For example, when hydrogen is introduced from the bottom of the separator, the fraction charged into the separator can be efficiently separated into the light fraction and the heavy residual oil and, at the same time, hydrogen necessary for the subsequent hydrotreating is sufficiently provided.

The light fraction separated in the high pressure separator 7 is introduced into the hydrotreating unit 6. It is desirable that the operation of the hydrotreating unit 6 is controlled so that the content of sulfur in the gas oil is controlled within the specified range of amount and, at the same time, other impurities such as nitrogen-containing impurities are removed. The operation conditions are similar to the corresponding conditions described previously. It is preferable that the pressure in the hydrotreating unit, in the hydrodesulfurization unit 2 and in the high pressure separator 7 are substantially the same.

When the pressures in the hydrodesulfurization unit 2, in the high pressure separator 7 and in the hydrotreating unit 6 are substantially the same, the energy consumed in these units can be minimized. Because the light fraction is hydrorefined after it is separated from the residual fraction, deactivation of hydrotreating catalyst by the heavy residual oil is prevented and the life of the catalyst is increased.

The fraction hydrotreated by the above process is introduced into the atmospheric distillation tower 3 singly or as a mixture with the heavy residual oil fraction separated in the high pressure separator and fractionated into the naphtha fraction, the kerosene fraction, the gas oil fraction and the heavy residual oil. Whether the hydrotreated fraction is distilled singly or as a mixture with the heavy residual oil fraction can be decided according to separation conditions between the light fraction and the heavy residual oil fraction in the high pressure separator. Separation into the naphtha fraction, the kerosene fraction and the gas oil fraction can be made by atmospheric distillation wherein the naphtha fraction, the kerosene fraction, the gas oil fraction, the heavy gas oil fraction and the residual crude are obtained by setting the cut temperatures at the range from $C_5$ to 157° C., at the range from 157° to 239° C., at the range from 239° to 370° C., at the range from 371° to 472° C. and at the range from 472° C. to higher temperatures, respectively.

Because the fractions ranging from the kerosene fraction to the residual crude which come out of the atmospheric distillation tower 3 are already hydrodesulfurized and hydrotreated, they can, after the heat is recovered by utilizing the heat exchanger with the crude oil according to necessity, be sent for storage directly to the storage tanks of the corresponding products or delivered directly to customers. The naphtha fraction can be desulfurized by the hydrodesulfurization unit 4 together with the naphtha separated from the crude oil according to necessity.

When crude oil is directly introduced into the desulfurization process without removing the naphtha fraction from the crude oil in the preliminary distillation tower, it is quite difficult that sulfur contained in the naphtha fraction is removed to the amount below the required level and the content of sulfur can not be reduced to 1 ppm or less. In this condition, the sulfur contained in the material acts as the poison to a reforming catalyst and may cause a problem in the processes following the desulfurization.

When, as described above, a series of the operations of the desulfurization, the high pressure separation and the hydrotreating is made after the naphtha fraction is removed from the crude oil, and the refined is fractionated, the units necessary for refining the crude oil are simplified to a great extent while the properties of the products are maintained at the same level or better than conventional products. Energy losses accompanied with the charging and discharging of materials to intermediate tanks can be eliminated by removing the intermediate tanks. Because the process of desulfurization and the process of hydrotreating are performed on the combined fractions at the same time, the control of operation is made more easily and it is further possible that the cost of investment for control instruments is reduced and the number of operator is reduced.

According to Embodiment 3, unstable substances which may be formed during the desulfurization process can be separated and removed during distillation in the main distillation tower. By performing the desulfurization so as to reduce the content of sulfur in the heavy residual oil to the value below the specified level, the content of sulfur in the light fractions can be reduced to the value below the level of conventional products. Stability and quality of the gas oil fraction can be improved by the process of Embodiment 3 because impurities such as nitrogen-containing compounds and metals in lighter fractions can be removed by the high pressure separation and the hydrotreating.

The method of Embodiment 4 which is described in more detail in the following provides the fractions having still better properties by a simplified process and increased yields of intermediated fractions such as kerosene and gas oil.

Figure 4:
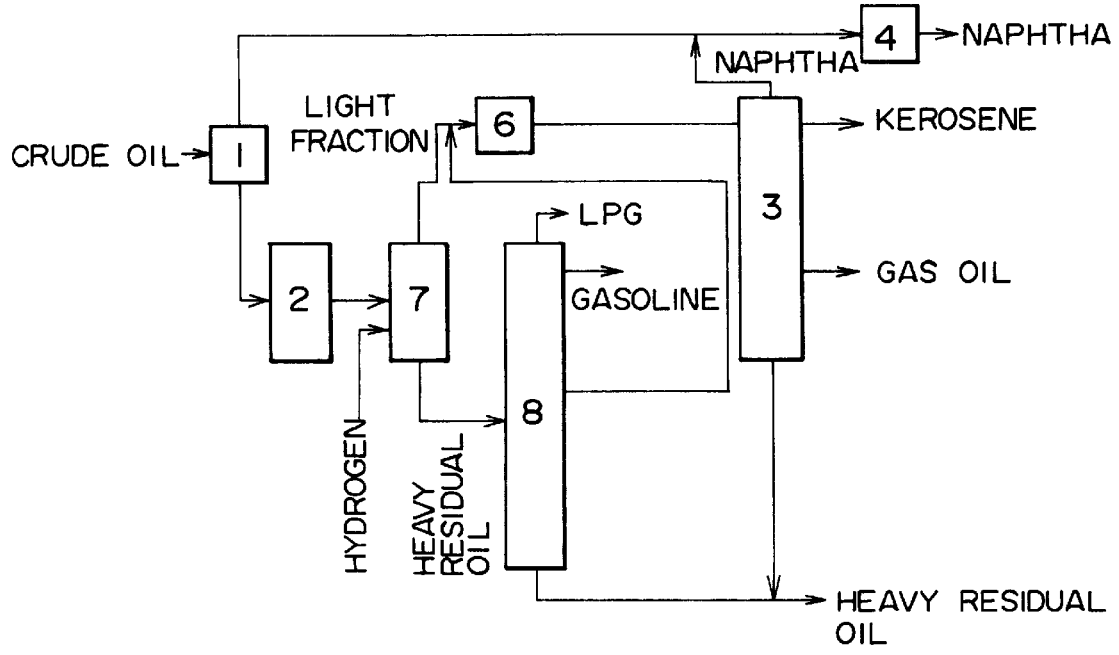

FIG. 4 is the schematic diagram of an example of the basic constitution of the units to perform the method of Embodiment 4.

The units for refining to perform the method of refining of Embodiment 4 comprise the preliminary distillation tower 1 to separate the naphtha fraction in the crude oil by distillation, the unit for desulfurization to desulfurize the residual fraction after the naphtha fraction has been removed, for example the hydrodesulfurization unit 2 to desulfurize the residual fraction by contact with a desulfurization catalyst in the presence of hydrogen, the high pressure separator 7 to separate fractions after the desulfurization at a high pressure, the fluid catalytic cracking unit 8 to crack the heavy residual oil fraction separated in the high pressure separator 7, the hydrotreating unit 6 to refine the light fraction separated by the high pressure separator 7 and the light fraction formed by the cracking in the fluid catalytic cracking unit 8 and the atmospheric distillation tower 3 to fractionate the fractions by distillation into individual fractions, such as kerosene, gas oil, and the heavy residual oil. The refining units for performing Invention 4 also comprise the hydrodesulfurization unit 4 to desulfurize the naphtha fraction separated in the preliminary distillation tower 1.

The naphtha fraction ($C_5$~157° C.) in crude oil is, at first, separated from the crude oil by distillation from the crude oil in the preliminary distillation tower 1. The condition of distillation is similar to the condition described in performing Embodiment 1.

The heavy fraction comprising the kerosene fraction and other heavier fractions which is the residual fraction in the preliminary distillation tower 1 is introduced into the hydrodesulfurization unit 2 without separating into its components. It is desirable that the desulfurization unit 2 is operated so that the content of sulfur in the final heavy residual oil is controlled within a specified range of amount. The condition of operation is similar to the condition described in performing Embodiment 1.

The fraction desulfurized in the above process is introduced into the high pressure separator 7 without preliminary separation into its components and then separated into the light fraction and the heavy residual oil. Various methods can be utilized for the separation in the high pressure separator. For example, when hydrogen is introduced from the bottom of the separator, the fraction charged into the separator can be efficiently separated into the light fraction and the heavy residual fraction and, at the same time, hydrogen necessary for the subsequent hydrotreating is sufficiently provided. The heavy residual fraction still amounts to almost 50 weight % of the initial crude oil and is not advantageous for utilization. Therefore, in the method of Embodiment 4, the residual heavy residual oil is catalytically cracked by the fluid catalytic cracking unit 8 and cracked gas oil and gasoline are obtained in the amount from 8 to 18 weight % based on the amount of the crude oil. The amount of the heavy residual fuel oil can be finally reduced to the amount from 2 to 5 weight % based on amount of the crude oil by this method. The fluid catalytic cracking is performed in the presence of a zeolite cracking catalyst comprising rare earth elements in the amount of 5 weight % or less, preferably in the range from 0.5 to 2 weight %, and zeolite in the amount in the range from 20 to 60 weight %, preferably in the range from 30 to 40 weight %, in the condition of the weight ratio of the catalyst to the oil in the range from 5 to 15, preferably in the range from 8 to 10, at the temperature in the range from 450° to 560° C., preferably in the range from 510° to 540° C., and at the pressure in the range from 1.0 to 3.0 kg/cm$^2$G.

The light fraction separated in the high pressure separator 7 and the cracked gas oil obtained in the fluid catalytic cracking unit 8 are introduced into the hydrotreating unit 6. It is desirable that the operation of the hydrotreating unit 6 is controlled so that the content of sulfur in the final gas oil is controlled within the specified range of amount and, at the same time, other impurities such as nitrogen-containing impurities are removed. The operation condition is similar to the corresponding condition in Embodiment 1.

The fraction hydrotreated by the above process is introduced into the atmospheric distillation tower 3, further fractionated and separated into individual fractions. The condition of the fractionation is similar to the corresponding condition in Embodiment 1.

Because the fractions such as the kerosene fraction and the light fraction which come out of the atmospheric distillation tower 3 are already treated with the hydrodesulfurization and the hydrotreating, they can, after the heat is recovered by utilizing the heat exchanger with the crude oil according to necessity, be sent for storage directly to the storage tanks of the corresponding products or delivered directly to customers. The naphtha fraction can be desulfurized by the hydrodesulfurization unit 4 together with the naphtha separated from the crude oil.

When crude oil is directly introduced into the desulfurization process without removing the naphtha fraction from the crude oil in the preliminary distillation tower, it is quite difficult that sulfur contained in the naphtha fraction is removed to the amount below the required level and the content of sulfur cannot be reduced to 1 ppm or less. In this condition, the sulfur contained in the material acts as the poison to a refining catalyst and may cause a problem in the processes following the desulfurization.

When, as described above, the naphtha fraction is removed from the crude oil, the operation of the fluid catalytic cracking unit is added to a series of the operations of the desulfurization and the hydrotreating and, then, the refined fraction is fractionated, the unit necessary for the refining of the crude oil is simplified to a great extent while the properties of the products are maintained at the level equal to or higher than conventional products. Energy losses accompanied with the charging and discharging of materials to intermediate tanks can be eliminated by removing the intermediate tanks. Because the process of desulfurization and the process of hydrotreating are performed on the combined fractions at the same time, the control of operation is made more easily and it is further possible that the cost of investment for control instruments is reduced and the number of operator is reduced.

According to Embodiment 4, unstable substances which may be formed during the desulfurization process can be separated and removed during distillation in the main distillation tower. By performing the desulfurization so as to reduce the content of sulfur in the heavy residual oil to the value below the specified level, the content of sulfur in the lighter fractions can be reduced to the value below the level of conventional products. Stability of the lighter fractions can be improved and the yields of the lighter fractions can be increased by the process of Embodiment 4 because impurities in the lighter fractions including the cracking gas oil, such as nitrogen-containing compounds, can be removed by the high pressure separation, the fluid catalytic cracking and the hydrotreating.

The invention is described in more detail in the following examples and comparative examples.

EXAMPLE 1

A crude oil having the following composition and properties was utilized and the naphtha fraction was separated at 157° C. by a preliminary distillation unit operated at the pressure of 1.5 kg/cm$^2$G.

| | |
|---|---|
| density (15° C.) | 0.9101 g/cm$^3$ |
| sulfur content | 2.78 weight % |
| nitrogen content | 0.14 weight % |
| vanadium | 41 weight ppm |
| nickel | 14 weight ppm |
| naphtha fraction ($C_5$~157° C.) | 20.0 weight % |
| kerosene fraction (157° C.~239° C.) | 13.0 weight % |
| gas oil fraction (239~370° C.) | 19.2 weight % |
| heavy gas oil fraction (370~472° C.) | 7.7 weight % |
| residual crude (above 472° C.) | 40.1 weight % |

The crude oil from which the naphtha fraction had been removed was introduced into a hydrodesulfurization unit loaded with a Co—Mo catalyst (CoO: 1.2 weight %, $Mo_2O_3$: 10.5 weight %, support: alumina/silica, surface area: 225 m$^2$/g, volume of pores: 0.62 cc/g) and desulfurized at the pressure of 135 kg/cm$^2$G, at the temperature of 390° C. and at the LHSV of 0.5 hr$^{-1}$. The amount of hydrogen consumption was 76 Nm$^3$/kl.

The oil hydrodesulfurized in the above was fractionated by an atmospheric distillation unit and separated into individual fractions. Properties of the fractions thus obtained are shown in Table 2.

COMPARATIVE EXAMPLE 1

The same crude oil as that utilized in Example 1 was refined by utilizing a conventional method. The conditions of the atmospheric distillation were: a stage number of tray: 45 stages, the pressure of the operation: 0.5 kg/cm$^2$G and the temperature at the inlet of the distillation tower: 370° C.

The crude oil was separated into individual fractions and the fractions were, after being temporarily stored in individual intermediate tanks, hydrodesulfurized individually. The conditions of hydrodesulfurization for the individual fractions are shown in Table 1. The same catalyst as that in Example 1 was utilized. Properties of the fractions thus prepared are shown in Table 2.

TABLE 1

| | temperature (°C.) | pressure (kg/cm$^2$G) | LHSV (hr$^{-1}$) |
|---|---|---|---|
| kerosene | 370 | 45 | 3.3 |
| gas oil | 380 | 45 | 3.0 |
| heavy gas oil | 390 | 56 | 2.0 |
| residual crude | 390 | 135 | 0.2 |

TABLE 2

| | yield of product (weight %) | density (15° C.) (g/cm$^3$) | content of sulfur (weight %) | content of nitrogen (weight %) |
|---|---|---|---|---|
| Example 1 | | | | |
| gas | 2.5 | — | — | — |
| naphtha | 2.3 | 0.7600 | 0.009 | 1>* |
| kerosene fraction | 16.0 | 0.7988 | 0.002 | 14* |
| gas oil fraction | 28.6 | 0.8463 | 0.10 | 0.02 |
| heavy gas oil fraction | 10.5 | 0.8795 | 0.22 | 0.08 |
| residual crude | 40.1 | 0.9379 | 0.68 | 0.21 |
| Comparative example 1 | | | | |
| gas | 1.9 | — | — | — |
| naphtha | 1.0 | 0.7600 | 0.009 | 1>* |
| kerosene fraction | 16.4 | 0.7960 | 0.004 | 29.4* |
| gas oil fraction | 32.1 | 0.8648 | 0.14 | 0.03 |
| heavy gas oil fraction | 15.0 | 0.9062 | 0.24 | 0.08 |
| residual crude | 33.6 | 0.9447 | 0.68 | 0.23 |

| | smoke point (m/m) | cetane number | carbon residue (wt. %) | vanadium (wt. ppm) | nickel (wt. ppm) |
|---|---|---|---|---|---|
| Example 1 | | | | | |
| gas | — | — | — | — | — |
| naphtha | — | — | — | — | — |
| kerosene fraction | 22.0 | — | — | — | — |
| gas oil fraction | — | 57 | — | — | — |
| heavy gas oil fraction | — | — | 0.01 | 0.05 or less | 0.05 or less |
| residual oil | — | — | 8.04 | 18.4 | 7.38 |
| Comparative example 1 | | | | | |
| gas | — | — | — | — | — |
| naphtha | — | — | — | — | — |
| kerosene fraction | 22.0 | — | — | — | — |
| gas oil fraction | — | 57 | — | — | — |
| heavy gas oil fraction | — | — | 0.01 | 0.05 or less | 0.05 or less |
| residual crude | — | — | 8.0 | 15.7 | 6.72 |

*weight ppm

EXAMPLE 2

A crude oil having the following composition and properties was utilized and the naphtha fraction was separated at 157° C. by a preliminary distillation unit operated at the pressure of 1.5 kg/cm$^2$G.

| | |
|---|---|
| density (15° C.) | 0.9040 g/cm$^3$ |
| sulfur content | 2.60 weight % |
| nitrogen content | 0.15 weight % |
| vanadium | 50 weight ppm |
| nickel | 15 weight ppm |
| naphtha fraction ($C_5$~157° C.) | 14.5 weight % |
| kerosene fraction (157° C.~239° C.) | 11.7 weight % |
| gas oil fraction (239~370° C.) | 20.9 weight % |
| heavy residual oil (above 370° C.) | 52.9 weight % |

The crude oil from which the naphtha fraction had been removed was introduced into a hydrodesulfurization unit loaded with a Co—Mo catalyst and desulfurized at the pressure of 135 kg/cm$^2$G, at the temperature of 390° C. and at the LHSV of 0.8 hr$^{-1}$. Properties of the catalyst utilized in the desulfurization are shown in Table 3.

The oil hydrodesulfurized in the above was introduced into a hydrotreating unit without fractionation and hydrotreated. The refined oil thus prepared was fractionated into the naphtha fraction of $C_5$~157° C., the kerosene fraction of 157~239° C., the gas oil fraction of 239 370° C. and the heavy residual oil of above 370° C. The results of the analysis of the fractions obtained are shown in Table 4. The hydrotreating was operated by using a Ni—Mo catalyst (hydrogenation catalyst (A) shown in Table 3) at the pressure of 135 kg/cm$^3$G, at the temperature of 360° C. and at the LHSV of 1.25 hr$^{-1}$.

EXAMPLE 3

The same crude oil as that in Example 2 was treated by the same processes as those in Example 2 except that another Ni—Mo catalyst (hydrogenation catalyst (B) shown in Table 3) was utilized for the hydrotreating. The hydrodesulfurized oil was introduced into a hydrotreating unit without fractionation and treated in the same way as in Example 2. The results of the analysis of the fractions obtained are shown in Table 4.

Figure 5:
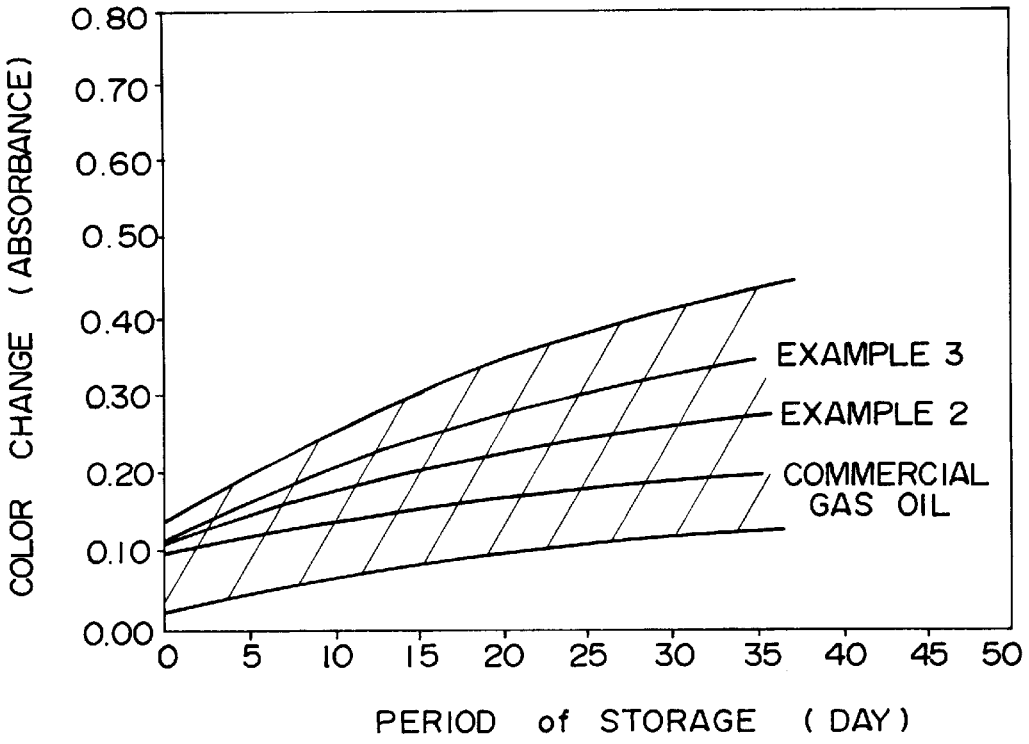
FIG. 5 shows the storage stability of the light gas oil fractions obtained in Examples 2 and 3.

Storage stability of the gas oil fractions obtained in Example 2 and Example 3 was evaluated by the following method. A 500 ml glass vessel having a vent containing 400 ml of the gas oil fraction obtained above was stored at a dark place kept at 43° C. A sample was taken out at a time of a specified interval and the absorbance at 470 nm was measured. The results of the measurement are shown in FIG. 5 and Table 5. The storage stability was evaluated according to the method of ASTM D4625-86. The results of an evaluation of a commercial gas oil are also shown as the reference in Table 5. The absorbance level of the storage stability test of commercial gas oil is generally in the range from 0.12 to 0.40 after the storage for 30 days. This range is shown in the FIG. 5 by the shaded area.

TABLE 3

| | desulfurization catalyst | Example 2 hydrogenation catalyst (A) | Example 3 hydrogenation catalyst (B) |
|---|---|---|---|
| CoO (weight %) | 1.2 | — | — |
| $NiO_2$ (weight %) | — | 4.0 | 3.0 |
| $Mo_2O_3$ (weight %) | 10.5 | 25.0 | 14.0 |
| support | alumina/silica | alumina | alumina/boria |
| surface area (m$^2$/g) | 225 | 116 | 260 |
| pore volume (cc/g) | 0.62 | 0.38 | 0.70 |

TABLE 4

| | density (15° C.) (g/cm$^3$) | yield (wt. %) | sulfur content (wt. ppm) | nitrogen content (wt. ppm) | smoke point (m/m) |
|---|---|---|---|---|---|
| Example 2 | | | | | |
| kerosene fraction | 0.7693 | 15.0 | 8 | 3 | 23.0 |
| gas oil fraction | 0.8471 | 31.5 | 500 | 51 | — |
| residual crude | 0.9350 | 52.5 | 5500 | 1600 | — |
| Example 3 | | | | | |
| kerosene fraction | 0.7980 | 14.0 | 8 | 6 | 23.0 |
| gas oil fraction | 0.8481 | 30.5 | 400 | 65 | — |
| residual crude | 0.9330 | 54.5 | 5200 | 1500 | — |

TABLE 4-continued

| | cetane number | carbon residue (wt. %) | vanadium (wt. ppm) | nickel (wt. ppm) |
|---|---|---|---|---|
| Example 2 | | | | |
| kerosene fraction | — | — | — | — |
| gas oil fraction | 58 | — | — | — |
| residual crude | — | 6.98 | 19.5 | 9.0 |
| Example 3 | | | | |
| kerosene fraction | — | — | — | — |
| gas oil fraction | 58 | — | — | — |
| residual crude | — | 7.23 | 20.1 | 9.2 |

TABLE 5

| | (Change of color) | | |
|---|---|---|---|
| | before the storage test (absorbance) | after the storage test of 30 days (absorbance) | formation of sludge |
| Example 2 | 0.11 | 0.25 | none |
| Example 3 | 0.11 | 0.32 | none |
| commercial gas oil | 0.09 | 0.19 | none |

EXAMPLE 4

A crude oil having the following composition and properties was utilized and the naphtha fraction was separated at 157° C. by a preliminary distillation unit operated at the pressure of 1.5 kg/cm$^2$G.

| | | |
|---|---|---|
| density (15° C.) | 0.9040 | g/cm$^3$ |
| sulfur content | 2.60 | weight % |
| nitrogen content | 0.15 | weight % |
| vanadium | 50 | weight ppm |
| nickel | 15 | weight ppm |
| naphtha fraction ($C_5$~157° C.) | 14.5 | weight % |
| kerosene fraction (157° C.~239° C.) | 11.7 | weight % |
| gas oil fraction (239~370° C.) | 20.9 | weight % |
| heavy residual oil (above 370° C.) | 52.9 | weight % |

The crude oil from which the naphtha fraction had been removed was introduced into a hydrodesulfurization unit loaded with a Co—Mo catalyst (CoO: 1.2 weight %, $Mo_2O_3$: 10.5 weight %, support: alumina/silica) and desulfurized in the condition to make the sulfur content of the heavy residual oil fraction 0.5 weight %: at the pressure of 135 kg/cm$^2$G, at the temperature of 380° C., at the LHSV of 0.6 hr$^{-1}$ and by utilizing hydrogen in the amount of 1,000 Nm$^3$/kl.

The oil thus desulfurized was transferred to a high pressure separator without reducing the pressure of the system and the light fraction was separated by introducing hydrogen from the bottom of the separator. The light fraction was introduced into a hydrotreating unit with an adequate amount of hydrogen and hydrotreated. The hydrotreated oil thus obtained was fractionated by the atmospheric distillation into a naphtha fraction of $C_5$~157° C., a kerosene fraction of 157~239° C. and a gas oil fraction of 239°~370° C. The hydrotreating was operated by using a Ni—Mo catalyst ($NiO_2$: 4.0 weight %, $Mo_2O_3$: 25.0 weight % and support: alumina) at the pressure of 135 kg/cm$^3$G, at the temperature of 320° C., by utilizing hydrogen in the amount of 1,000 Nm$^3$/kl and at the LHSV of 2.0 hr$^{-1}$.

COMPARATIVE EXAMPLE 2

The same crude oil as that utilized in Example 4 was distilled at the atmospheric pressure by a conventional method and fractionated into a kerosene fraction, a gas oil fraction and a heavy residual oil fraction. The fractions were hydrodesulfurized individually. The conditions for the hydrodesulfurization are shown in Table 6.

Properties of kerosene and gas oil obtained in Example 4 and Comparative example 2 are shown in Table 7. It is clearly shown in the table that the kerosene and the gas oil obtained by the method of the present invention had particularly small nitrogen contents and were excellent also with respect to the smoke point and the cetane number.

Figure 6:
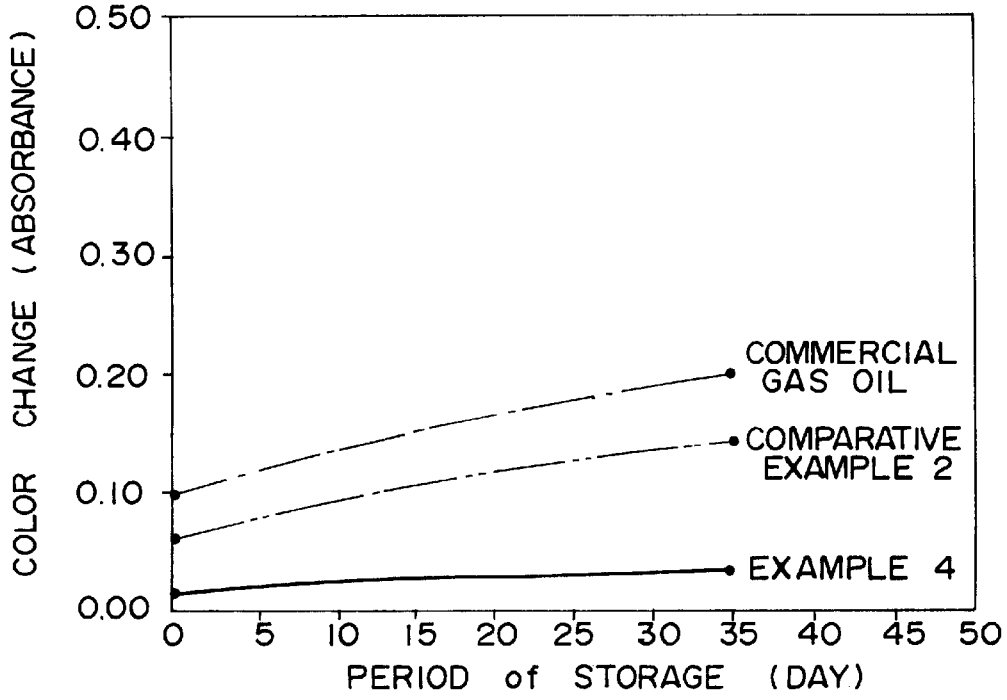
FIG. 6 shows the storage stability of the gas oil light fractions obtained in Example 4 and Comparative example 2.

Storage stability of the gas oil fractions obtained in Example 4 and Comparative example 2 was evaluated by the following method. A 500 ml glass vessel having a vent containing 400 ml of the gas oil fraction obtained above was stored at a dark place kept at 43° C. A sample was taken out at a time of a specified interval and the absorbance at 470 nm was measured. The results of the measurement are shown in FIG. 6 and Table 8. The storage stability was evaluated according to the method of ASTM D4625-86. The results of an evaluation of a commercial gas oil (prepared from a hydrodesulfurized gas oil and straight-run gas oil which is the material of the hydrodesulfurized gas oil, to meet the specification of the gas oil) are also shown as the reference in Table 5. The absorbance level of the storage stability test of the commercial gas oil is generally in the range from 0.12 to 0.40 after the storage for 30 days.

TABLE 6

| | temperature (°C.) | pressure (kg/cm$^2$G) | LHSV (hr$^{-1}$) |
|---|---|---|---|
| kerosene | 320 | 40 | 5 |
| gas oil | 360 | 40 | 3 |
| heavy residual oil | 370 | 135 | 0.2 |

TABLE 7

| | kerosene fraction | | gas oil fraction | |
|---|---|---|---|---|
| | Example 4 | Comparative example 2 | Example 4 | Comparative example 2 |
| density (g/cm$^3$) | 0.7933 | 0.7990 | 0.8397 | 0.8403 |
| sulfur content (weight ppm) | 4 | 38 | 200 | 900 |
| nitrogen content (weight ppm) | 1> | 1> | 1> | 68 |
| smoke point (m/m) | 31.0 | 24.5 | — | — |
| cetane number | — | — | 63 | 61 |
| distillation temperature (°C.) | | | | |
| initial boiling point | 164.5 | 162.5 | 203.0 | 211.5 |
| 5% | 179.5 | 174.0 | 235.0 | 237.0 |
| 10% | 182.5 | 179.5 | 254.0 | 255.5 |
| 50% | 204.0 | 200.0 | 302.0 | 297.0 |
| 95% | 253.0 | 245.5 | 361.0 | 366.5 |
| end point | 267.5 | 262.5 | 378.0 | 375.0 |
| composition | | | | |
| saturates (volume %) | 89.2 | 82.7 | 80.0 | 72.0 |
| olefins (volume %) | 0.0 | 0.8 | 0.1 | 0.8 |
| aromatics (volume %) | 10.8 | 16.5 | 19.9 | 27.2 |

TABLE 8

| | (Change of color) | | |
|---|---|---|---|
| | before the storage test (absorbance) | after the storage test of 30 days (absorbance) | formation of sludge |
| Example 4 | 0.01 | 0.03 | none |
| Comparative example 2 | 0.06 | 0.14 | none |

COMPARATIVE EXAMPLE 3 AND EXAMPLE 5

A crude oil having the following composition and properties was utilized and the naphtha fraction was separated at 157° C. by a preliminary distillation unit operated at the pressure of 1.5 kg/cm$^2$G.

| | | |
|---|---|---|
| density (15° C.) | 0.9040 | g/cm$^3$ |
| sulfur content | 2.60 | weight % |
| nitrogen content | 0.15 | weight % |
| vanadium | 50 | weight ppm |
| nickel | 15 | weight ppm |
| naphtha fraction ($C_5$~157° C.) | 14.5 | weight % |
| kerosene fraction (157° C.~239° C.) | 11.7 | weight % |
| gas oil fraction (239~370° C.) | 20.9 | weight % |
| heavy residual oil (above 370° C.) | 52.9 | weight % |

The crude oil from which the naphtha fraction had been removed was introduced into a hydrodesulfurization unit loaded with a Co—Mo catalyst (CoO: 1.2 weight %, $Mo_2O_3$: 10.5 weight %, support: alumina/silica) and desulfurized at the pressure of 135 kg/cm$^2$G, at the temperature of 380° C., at the LHSV of 0.6 hr$^{-1}$ and by utilizing 1,000 Nm$^3$ of hydrogen per kiloliter of feed.

The oil thus hydrodesulfurized was transferred to a high pressure separator without reducing the pressure of the system and the light fraction was separated by introducing hydrogen from the bottom of the separator. The heavy residual oil was then transferred to the fluid catalytic cracking apparatus and cracked to the fractions of gas, LPG, gasoline, cracked gas oil and heavy oil. The cracking was operated in the presence of a commercial catalyst for the fluid catalytic cracking (kaolin/alumina of USY type containing 40 weight % of zeolite and 0.5 weight % of rare earth elements) at the weight ratio of the catalyst to the oil of 7, at the temperature of 520° C. and at the pressure of 1.5 kg/cm. The cracked gas oil obtained here was utilized in Comparative example 3. The properties of the cracked gas oil are shown in Table 9. The yield of the cracked gas oil was 9.6 weight % based on the crude oil.

The cracked gas oil thus obtained was pressured, mixed with the lighter fraction obtained before, introduced into a hydrotreating unit and hydrotreated. The refined oil was fractionated by the atmospheric distillation tower into a naphtha fraction of $C_5$~157° C., a kerosene fraction of 157°~239° C. and a gas oil fraction of 239°~370° C. The result of the analysis of the gas oil fraction thus obtained is shown as Example 5 in Table 9. The yield of the gas oil fraction was 35.1 weight % based on the crude oil. The hydrotreating was operated in the presence of a Ni—Mo catalyst (Ni: 4 weight %, Mo: 25 weight % and support: alumina) at the pressure of 135 kg/cm$^3$G, at the temperature of 340° C., by utilizing 1,000 Nm$^3$ of hydrogen per kiloliter of feed and at the LHSV of 1.0 hr$^{-1}$.

COMPARATIVE EXAMPLE 4

The same crude oil as that utilized in Example 5 was distilled at the atmospheric pressure by a conventional method and fractionated into a kerosene fraction, a gas oil fraction and a heavy residual oil fraction. The fractions were hydrodesulfurized individually. The conditions for the hydrodesulfurization are shown in Table 10. The desulfurized heavy residual oil obtained by desulfurizing the heavy residual oil fraction obtained above was then introduced into the fluid catalytic cracking unit and cracked to the fractions of gas, LPG, gasoline, cracked gas oil and heavy oil. The condition of the cracking is the same as that in Example 5. Properties of the cracked gas oil are shown in Table 9.

Figure 7:
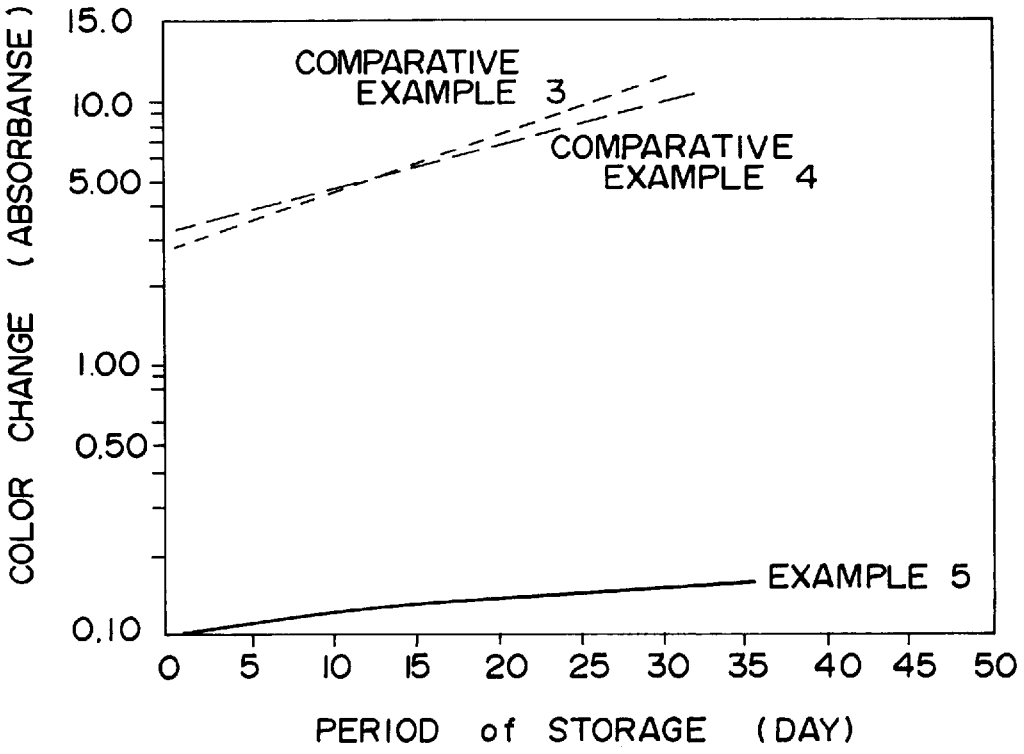
FIG. 7 shows the storage stability of the light gas oil fractions obtained in Example 5, Comparative examples 3 and 4.

Storage stability of the gas oil fractions obtained in Example 5 and Comparative examples 3 and 4 was evaluated by the following method. A 500 ml glass vessel having a vent containing 400 ml of the gas oil fraction obtained above was stored at a dark place kept at 43° C. A sample was taken out at a time of a specified interval and the absorption at 470 nm was measured. The results of the measurement are shown in FIG. 7 and Table 9. The storage stability was evaluated according to the method of ASTM D4625-86. The absorbance level of the storage stability test of commercial gas oil is generally in the range from 0.12 to 0.40 after the storage for 30 days.

The results in Table 9 show that a cracked gas oil in Comparative example 4, had a low cetane number and contained a remarkably large amount of aromatic components. It also had inferior storage stability and was colored with time during the storage to a large extent, finally having dark brown color. All of these problems can be improved by hydrotreating in combination with the lighter fraction and the satisfactory properties and qualities as the gas oil are realized.

TABLE 9

| | Example 5 | Comparative example 3 | Comparative example 4 |
|---|---|---|---|
| density (g/cm$^3$) | 0.8400 | 0.9327 | 0.9289 |
| ASTM color | 0.5 | 2.5 | 3.0 |
| sulfur content (weight ppm) | 100 | 1800 | 2100 |
| nitrogen content (weight ppm) | 1 | 740 | 690 |
| cetane number | 57 | 19 | 20 |
| distillation temperature (°C.) | | | |
| initial boiling point | 227.0 | 185.0 | 190.0 |
| 5% | 251.0 | 204.0 | 203.5 |
| 10% | 266.0 | 209.5 | 208.0 |
| 50% | 308.0 | 258.0 | 255.5 |
| 90% | 357.0 | 352.0 | 351.5 |
| 95% | 369.0 | 371.0 | 369.5 |
| end point | 380.0 | 377.0 | 374.0 |
| composition | | | |
| saturated components (volume %) | 87.0 | 18.5 | 16.0 |
| olefins (volume %) | 0.0 | 8.0 | 8.0 |
| aromatic components (volume %) | 13.0 | 73.5 | 76.0 |

TABLE 10

| | temperature (°C.) | pressure (kg/cm$^2$G) | LHSV (hr$^{-1}$) |
|---|---|---|---|
| kerosene | 320 | 40 | 5 |
| gas oil | 360 | 40 | 3 |
| heavy residual oil | 370 | 135 | 0.2 |

INDUSTRIAL APPLICABILITY

According to the method of the invention, cost for unit can be reduced to a large extent by the elimination of intermediate tanks and the unification of the desulfurization units. Running cost can also be reduced by efficient utilization of energy because the decrease of temperature during the temporary storage in the intermediate tanks can be avoided. Better control of operation can be realized by integration of the functions of units ranging from the preliminary distillation apparatus to the final fractionation unit into a unified system of the units as well as by the elimination of the intermediate tanks and by the unification of the desulfurization units. Hence, instruments and expenses necessary for the control of the units can be reduced and number of the operator can also be decreased.

It is rather surprising that the contents of sulfur in each of kerosene, gas oil and heavy residual oil can be reduced to the required levels by setting the condition of the desulfurization according to the content of sulfur in the heavy residual oil in the atmospheric distillation. This method has a further advantage that life of the catalyst is made longer than that in direct desulfurization of fuel oil.

It is estimated by the present inventors that the unit cost can be reduced by about 10% and the running cost can be reduced by about 20% when the refining units have the capacity of 100,000 barrels per day.

Thus, according to the method of the invention, the cost of refining of petroleum can be reduced to a great extent and various kinds of inexpensive petroleum products and inexpensive raw materials in the field of petroleum chemistry can be provided.

Storage stability of the products can be improved by elimination of impurities such as sulfur and nitrogen by treatment with hydrotreating.

Quality and properties of kerosene and gas oil, such as smoke point and cetane number and storage stability of them can be improved by complete elimination of impurities such as sulfur and nitrogen by treatment in the high pressure separator and the hydrotreating unit. For example, the kerosene fraction prepared by the method of the invention has a smoke point of 30 or more and the gas oil fraction prepared by the method of the invention has a cetane number of 60 or more. The both fractions have a low sulfur content, a low nitrogen content and a high content of saturated components and are not colored after the storage stability test but remained in the colorless and transparent condition to exhibit the quite high quality of the products.

The life of the catalyst utilized in the process is increased because deactivation of the catalyst is prevented by the process that the hydrotreating is operated after the heavy residual oil is separated in advance.

Because the high pressure separator, the fluid catalytic cracking unit and the hydrotreating unit are utilized, impurities such as sulfur and nitrogen are completely removed and the storage stability and the qualities such as cetane number of gas oil can be improved. And cracked gas oil which has been known to have low stability and evaluated low can be improved to have better qualities and higher added values. Furthermore, yields of intermediate fractions such as kerosene and gas oil can be increased to a great extent.

We claim:

1. A method of refining crude oil by distillation and desulfurization for preparation of petroleum products which comprises separating a naphtha fraction from crude oil by a first distillation, hydrodesulfurizing at a pressure of 100 to 200 kg/cm$^2$G a residual fraction which remains after the naphtha fraction has been removed from the crude oil, separating the hydrodesulfurized fraction into a light fraction and a heavy residual oil in a high pressure separator, hydrotreating at a pressure of 100 to 200 kg/cm$^2$G the light fraction and separating the hydrotreated light fraction by a second distillation into a kerosene fraction, a light gas oil fraction, a naphtha fraction and a residual crude fraction.

2. A method of refining crude oil by distillation and desulfurization for preparation of petroleum products which comprises separating a naphtha fraction from crude oil by a first distillation, hydrodesulfurizing at a pressure of 100 to 200 kg/cm$^2$G a residual fraction which remains after the naphtha fraction has been removed from the crude oil, separating the hydrodesulfurized fraction into a light fraction and a heavy residual oil in a high pressure separator, cracking the heavy residual oil by fluid catalytic cracking, fractionating the cracked heavy residual oil by a second distillation, combining a cracked gas oil fraction obtained by the fractionation by the second distillation with the light fraction separated in the high pressure separator, hydrotreating at a pressure of 100 to 200 kg/cm$^2$G the combined fraction and separating the hydrotreated combined fraction into further fractions by a third distillation into a kerosene fraction, a light gas oil fraction, a naphtha fraction and a residual crude fraction.

3. The method of refining crude oil by distillation and desulfurization for preparation of petroleum products as claimed in any one of claims 1 or 2 wherein the hydrotreating is operated in the presence of a catalyst containing Mo or W and Ni.

4. The method of refining crude oil by distillation and desulfurization for preparation of petroleum products as claimed in claim 1 or claim 2 wherein the residual fraction is, after being hydrodesulfurized, separated into a light fraction and a heavy residual oil in the high pressure separator by introduction of hydrogen into the separator.

5. The method of refining crude oil by distillation and desulfurization for preparation of petroleum products as claimed in claim 1 wherein the process in which the residual fraction is hydrodesulfurized, the process in which the hydrodesulfurized residual oil is separated into a light fraction and a heavy residual oil in a high pressure separator and the process in which the light fraction is hydrotreated are all operated at substantially the same pressure.

6. The method of refining crude oil by distillation and desulfurization for preparation of petroleum products as claimed in claim 5, wherein the hydrodesulfurizing is carried out at a reaction temperature of 370° to 420° C., a liquid hourly space velocity of 0.2 to 2.0 hr$^{-1}$ and an amount of hydrogen of 800 to 2000 Nm$^3$/kl.

7. The method of refining crude oil by distillation and desulfurization for preparation of petroleum products as claimed in claim 1, wherein the naphtha fraction has a boiling point of 157° C. or less, the residual fraction has a boiling point of 157° C. or more, the light fraction has a boiling point of 157° to 370° C. and the heavy residual oil has a boiling point of 370° C. or more.

8. The method of refining crude oil by distillation and desulfurization for preparation of petroleum products as claimed in claim 7, wherein the hydrodesulfurizing is carried out at a reaction temperature of 370° to 420° C., a liquid hourly space velocity of 0.2 to 2.0 hr$^{-1}$ and an amount of hydrogen of 800 to 2000 Nm$^3$/kl.

9. The method of refining crude oil by distillation and desulfurization for preparation of petroleum products as claimed in claim 1, wherein the naphtha fraction has a boiling point of 157° C. or less; the first distillation is carried out at a pressure of atmospheric pressure to 10 kg/cm$^2$G and at a temperature of 145° to 200° C.; the hydrodesulfurization is carried out so that the content of the sulfur is controlled within 1 weight % or less, in the presence of a catalyst comprising one or more of Mo, W, Co and Ni, at a temperature of 300° to 450° C., at a liquid hourly space velocity of 0.1 to 5.0 hours$^{-1}$ and with an amount of hydrogen of 500 to 5,000 Nm$^3$/kl.

10. The method of refining crude oil by distillation and desulfurization for preparation of petroleum products as claimed in claim 9, wherein the hydrodesulfurization is carried out at a temperature of 370° to 420° C., a liquid hourly space velocity of 0.2 to 2.0 hour$^{-1}$ and an amount of hydrogen of 800 to 2,000 Nm$^3$/kl.

11. The method of refining crude oil by distillation and desulfurization for preparation of petroleum products as claimed in claim 1, wherein the hydrodesulfurizing is carried out at a reaction temperature of 370° to 420° C., a liquid hourly space velocity of 0.2 to 2.0 hr$^{-1}$ and an amount of hydrogen of 500 to 2000 Nm$^3$/kl.

12. The method of refining crude oil by distillation and desulfurization for preparation of petroleum products as claimed in claim 1, wherein the hydrotreating is carried out at a reaction temperature of 320° to 360° C., a liquid hourly space velocity of 0.2 to 2.0 hr$^{-1}$ and an amount of hydrogen of 800 to 2000 Nm$^3$/kl.

13. The method of refining crude oil by distillation and desulfurization for preparation of petroleum products as claimed in claim 2, wherein the naphtha fraction has a boiling point of 157° C. or less, the residual fraction has a boiling point of 157° C. or more, the light fraction has a boiling point of 157° to 370° C. and the heavy residual oil has a boiling point of 370° C. or more.

14. The method of refining crude oil by distillation and desulfurization for preparation of petroleum products as claimed in claim 2, wherein the fluid catalytic cracking is carried out in the presence of a zeolite cracking catalyst comprising 0.5 to 2 weight % rare earth elements, with a weight ratio of catalyst to oil of 5 to 15, at a temperature of 450° to 560° C. and at a pressure of 1.0 to 3.0 kg/cm$^2$G.

15. The method of refining crude oil by distillation and desulfurization for preparation of petroleum products as claimed in claim 14, wherein the weight ratio of catalyst to oil is 8 to 10 and the temperature is 510° to 540° C.

16. The method of refining crude oil by distillation and desulfurization for preparation of petroleum products as claimed in claim 2, wherein the naphtha fraction has a boiling point of 157° C. or less; the first distillation is carried out at a pressure of atmospheric pressure to 10 kg/cm$^2$G and at a temperature of 145° to 200° C.; the hydrodesulfurization is carried out so that the content of the sulfur is controlled within 1 weight a or less, in the presence of a catalyst comprising one or more of Mo, W, Co and Ni, at a temperature of 300° to 450° C., at a liquid hourly space velocity of 0.1 to 5.0 hour$^{-1}$ and with an amount of hydrogen of 500 to 5,000 Nm$^3$/kl.

17. The method of refining crude oil by distillation and desulfurization for preparation of petroleum products as claimed in claim 16, wherein the hydrodesulfurization is carried out at a temperature of 370° to 420° C., a liquid hourly space velocity of 0.2 to 2.0 $hour^{-1}$ and an amount of hydrogen of 800 to 2,000 $Nm^3$/kl.

18. The method of refining crude oil by distillation and desulfurization for preparation of petroleum products as claimed in claim 2, wherein the hydrodesulfurizing is carried out at a reaction temperature of 370° to 420° C., a liquid hourly space velocity of 0.2 to 2.0 $hr^{-1}$ and an amount of hydrogen of 500 to 2000 $Nm^3$/kl.

19. The method of refining crude oil by distillation and desulfurization for preparation of petroleum products as claimed in claim 2, wherein the hydrotreating is carried out at a reaction temperature of 320° to 360° C., a liquid hourly space velocity of 0.2 to 2.0 $hr^{-1}$ and an amount of hydrogen of 800 to 2000 $Nm^3$/kl.

* * * * *